United States Patent [19]

Theurer et al.

[11] 4,355,687

[45] Oct. 26, 1982

[54] BALLAST LEVELING APPARATUS AND METHOD

[75] Inventors: Josef Theurer, Vienna; Karl Fölser, Linz-Urfahr, both of Austria

[73] Assignee: Franz Plasser Bahnbaumaschinen-Industriegesellschaft m.b.H., Vienna, Austria

[21] Appl. No.: 202,079

[22] Filed: Oct. 30, 1980

[30] Foreign Application Priority Data

Nov. 23, 1979 [AT] Austria ..... 7461/79

[51] Int. Cl.[3] ..... E01B 27/10

[52] U.S. Cl. ..... 171/16; 104/7 A

[58] Field of Search ..... 171/16; 107/7 A, 7 B, 107/2, 12

[56] References Cited

U.S. PATENT DOCUMENTS

| | | | |
|---|---|---|---|
| 2,921,636 | 1/1960 | Andres et al. | 171/16 |
| 3,096,829 | 7/1963 | Plasser et al. | 171/16 |
| 3,356,157 | 12/1967 | Plasser et al. | 171/16 |
| 3,436,848 | 4/1969 | Peppin et al. | 171/16 |
| 4,010,691 | 3/1977 | Theurer et al. | 104/7 A |
| 4,133,388 | 1/1979 | Boyer | 171/16 |
| 4,267,777 | 5/1981 | Folser et al. | 171/16 |

FOREIGN PATENT DOCUMENTS

| | | | |
|---|---|---|---|
| 207876 | 3/1960 | Austria | 171/16 |
| 210458 | 1/1960 | Fed. Rep. of Germany | 171/16 |
| 1759235 | 9/1976 | Fed. Rep. of Germany | 171/16 |
| 2226612 | 1/1973 | Italy | 171/16 |
| 1052450 | 12/1966 | United Kingdom | 171/16 |

*Primary Examiner*—Robert A. Hafer
*Attorney, Agent, or Firm*—Kurt Kelman

[57] ABSTRACT

A ballast leveling apparatus mounted on a mobile ballast cleaning machine comprises a pair of endless ballast leveling chains, a vertical pivot in each ballast bed shoulder and supporting a respective chain for pivoting in a plane underneath the track, a rotary drive for driving each ballast leveling chain and a power drive linking each chain to the machine frame for vertically adjusting the chain. In the automatic ballast leveling method using this apparatus, ballast is removed from a surface layer of uneven ballast distribution to a predetermined, controlled depth and simultaneously conveyed to two paths from the center of the ballast bed towards the shoulders while filling any depressions in the ballast bed in the paths of the conveyed ballast with the conveyed ballast to level the ballast bed.

10 Claims, 3 Drawing Figures

BALLAST LEVELING APPARATUS AND METHOD

The present invention relates to a ballast leveling apparatus mounted on a ballast cleaning machine including a frame and adapted to move in an operating direction on a track including ties resting on a ballast bed having two shoulders laterally adjacent the track, the machine frame supporting a ballast excavating means for removing ballast from a region of the ballast bed underneath the track, a ballast screening arrangement for separating the removed ballast into cleaned ballast and waste, and conveyor means for redistributing cleaned ballast to the excavated region of the ballast bed. This invention also relates to an automatic ballast leveling method using such apparatus.

Austrian Pat. No. 210,458, published Aug. 10, 1960, discloses an apparatus for compacting the sub-grade of a region of a ballast bed from which the ballast has been removed for cleaning This sub-grade compacting apparatus is mounted on a mobile ballast cleaning machine rearwardly of suitable ballast excavating means in the operating direction of the machine and is comprised of a pair of compactors pivotal in a plane underneath the track about vertical pivots in each ballast bed shoulder. The cleaned ballast is redistributed rearwardly of the compactors in the operating direction so that it is received on the compacted subgrade. No means is provided for leveling or compacting the redistributed cleaned ballast.

U.S. Pat. No. 3,096,829, dated July 9, 1963, discloses a ballast treating machine which moves on tracked undercarriages supporting the machine frame on the ballast bed shoulders while being guided along the track by flanged wheels engaging the track. The machine is equipped with a first bucket conveyor for removing ballast in the ballast bed shoulder region, a ballast excavating chain rearwardly of the first bucket conveyor and pivotal in a plane underneath the track for removing ballast from under the track, and a second bucket conveyor rearwardly of the excavating chain for removing the ballast conveyed by the excavating chain to the shoulder of the ballast bed. The ballast removed by the bucket conveyors is cleaned and the cleaned ballast is redistributed by a pivotal conveyor to the ballast bed rearwardly of the machine. This machine, too, requires additional equipment for leveling the redistributed cleaned ballast before it is capable of supporting the track in operating condition.

U.S. Pat. No. 4,010,691, dated Mar. 8, 1977, discloses a ballast leveling apparatus mounted on a ballast cleaning machine and arranged thereon rearwardly of the cleaned ballast redistributing means. The apparatus comprises vibratory bars attached to the transversely extending portion of the ballast excavating chain by ropes for improving the distribution of the cleaned ballast over the width of the ballast bed and for leveling local ballast accumulations.

German Patent Application No. 2,226,612, published Jan. 4, 1973, discloses a mobile ballast cleaning machine with two overlapping ballast excavating chains overlapping in the center region of the ballast bed and removing excavated ballast to the shoulders. This excavating chain arrangement produces unfavorable and asymmetrical stresses in relation to the center line of the ballast bed, thus subjecting the excavating chains and their bearing elements on the machine frame to irregular loads. The cleaned ballast is somewhat randomly redistributed and no means is provided for leveling or compacting the redistributed ballast.

Accepted German Patent Application No. 1,759,235, published Sept. 23, 1976, discloses a mobile ballast cleaning machine with a vertically adjustable ballast leveling device arranged rearwardly of a ballast excavating chain for leveling the redistributed cleaned ballast. Control means is disclosed for adjusting the level and superelevation of the ballast leveling device whose structure is not further described.

It is the primary object of the invention to provide a ballast leveling apparatus and method for use with a mobile ballast cleaning machine, which assures optimum and individually controllable ballast bed support for a track after the ballast has been cleaned and redistributed to the excavated ballast bed region.

The above and other objects are accomplished according to one aspect of the present invention with a ballast leveling apparatus mounted on a ballast cleaning machine of the first-described type, which is comprised of a pair of endless ballast leveling chains, a vertical pivot in each ballast bed shoulder and supporting a respective one of the endless ballast leveling chains for pivoting in a plane underneath the track, a rotary drive for driving each ballast leveling chain, and a power drive linking each ballast leveling chain to the machine frame for vertically adjusting the ballast leveling chain independently of the ballast excavating means.

According to another aspect of this invention ballast is automatically leveled in successive regions of a ballast bed having two shoulders laterally adjacent a track supported on the ballast bed by excavating ballast underneath each region of the ballast bed, cleaning the excavated ballast, redistributing the cleaned ballast in the region, the redistributed cleaned ballast having a surface layer of uneven ballast distribution, and removing ballast from the suface layer to a predetermined, controlled depth and simultaneously conveying the removed surface layer ballast in two paths from the center of the ballast bed towards the shoulders while filling any depressions in the ballast bed in the paths of the conveyed ballast with the conveyed ballast to level the ballast bed in the region.

This leveling apparatus and method for the first time enable the ballast bed to be restored to a geometrically accurate and completely leveled condition free of any unevenness in ballast distribution and grade after the ballast has been excavated, cleaned and redistributed in the ballast bed. Since the vertical adjustment of the leveling apparatus is independent of the ballast excavating means, the depth of removal of ballast by the ballast leveling chains may be controlled closely according to the amount of cleaned ballast available in the treated region of the ballast bed and the corresponding height of the redistributed layer of cleaned ballast. This control of the vertical position of the ballast leveling chains may also be automatically responsive to a reference system for determining the grade as well as the superelevation of the track supported on the ballast bed. A ballast bed restored in this manner has, therefore, practically the same accurate grade, uniformity and surface condition as a newly laid ballast bed on which a track is subsequently laid. Therefore, only minor track corrections are required to obtain the desired track position during subsequent tamping of the track ties usually effected after a ballast cleaning operation.

Compared to transversely extending ballast leveling rods or bars which have a certain ballast compacting effect which differs greatly from region to region, depending on the difference in the height of the layer of redistributed cleaned ballast, the driven endless ballast leveling chains of the invention scrape excess ballast off the surface of the redistributed cleaned ballast while avoiding uneven compaction of the ballast since the excess ballast in the path of the driven chains is simply conveyed from the center to the shoulders of the ballast bed while any depressions in the ballast bed in the paths of the conveyed ballast are filled with the conveyed excess ballast. The resultant ballast bed has a geometrically accurate grade and uniform compaction or density to provide an excellent basis for the subsequent work of additional ballast compactors.

The driven endless ballast leveling chains have the additional advantage that the rotary drive for driving the chain requires considerably less energy than is required additionally to impart forward motion to a machine which pulls along a plow-like leveling device to overcome the considerable friction forces produced by the movement of the plow-like leveling device over the ballast.

The above and other objects, advantages and features of this invention will become more apparent from the following detailed description of a now preferred embodiment of the apparatus, taken in conjunction with the accompanying schematic drawing wherein.

Figure 1:
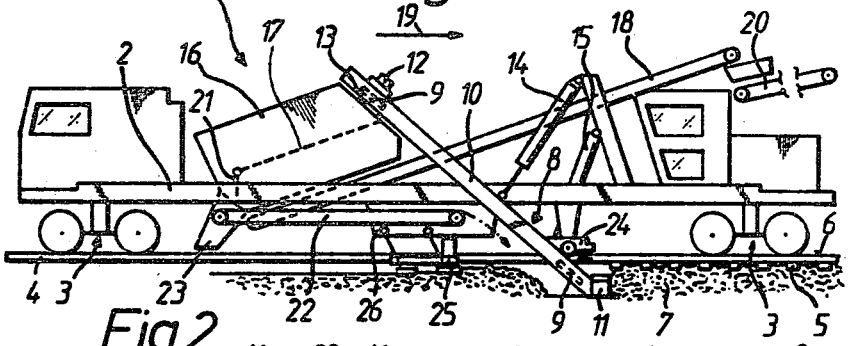
FIG. 1 is a side elevational view of a mobile ballast cleaning machine incorporating the ballast leveling apparatus of the invention.

Referring now to the drawing, there is shown ballast cleaning machine 1 including frame 2 and adapted to move on undercarriages 3, 3 in an operating direction indicated by arrow 19 on track 6 including ties 5 resting on ballast bed 7 having two shoulders laterally adjacent track 6. Track rails 4 are fastened to ties 5 and the wheels of the undercarriages run on the track rails. Machine frame 2 supports ballast excavating means for removing ballast from a region of ballast bed 7 underneath track 6. The illustrated ballast excavating means comprises endless scraper and conveying chain 8 trained over sprockets 9 to run in a polygonal path in elongated inclined guides 10 rising from transverse guide 11 extending underneath the track. Elongated chain guides 10 are arranged on each side of machine frame 2 and have upper ends which are pivoted to the machine frame for universal movement at 13, chain drive 13 for the excavating chain being mounted in the region of the universal pivoting means supporting the chain guides 10 on machine frame 2. Power drives 14 and 15, which are illustrated as hydraulic motors, link chain guides 10 to the machine frame for pivoting the ballast excavating means laterally and vertically into desired positions in relation to ballast bed 7.

Machine frame 2 also supports ballast screening arrangement 16 for separating the removed ballast into cleaned ballast and waste. The removed ballast is raised by scraper and conveying chain 8 along one of elongated guides 10 and is dumped into the screening arrangement, the waste passing through screen 17 to waste removal conveyor 18 which moves the waste forwardly in the operating direction to a further conveyor 20. The latter conveyor is laterally pivotal and is driven at relatively high speed to throw the waste into non-illustrated waste removal trucks or railroad cars, or to deposit it on the shoulder of the ballast bed. The screening arrangement furthermore has a controlled gate 21 enabling the cleaned ballast to be directed from screen 17 to conveyor means for redistributing cleaned ballast to the excavated region of the ballast bed. The illustrated conveyor means includes two elongated conveyors 22 arranged at the sides of machine frame 2 and having a discharge portion for depositing cleaned ballast in the excavated region of the ballast bed rearwardly of transversely extending ballast excavating means portion 11 in the operating direction, and chute 23 arranged forwardly of rear undercarriage 3 in the operating direction for redistributing cleaned ballast in the cribs.

A track lifting unit 24 is mounted on machine frame forwardly of the ballast excavating means in the operating direction for lifting the track ahead of the ballast bed region to be excavated.

Ballast cleaning machines incorporating the above-described structures are well known and generally shown, for example, in U.S. Pat. No. 4,010,691.

Leveling apparatus 25 according to the present invention is mounted on machine frame 2 between track lifting unit 24 and chute 23, the machine frame having support part 26 carrying the apparatus.

Figure 2:
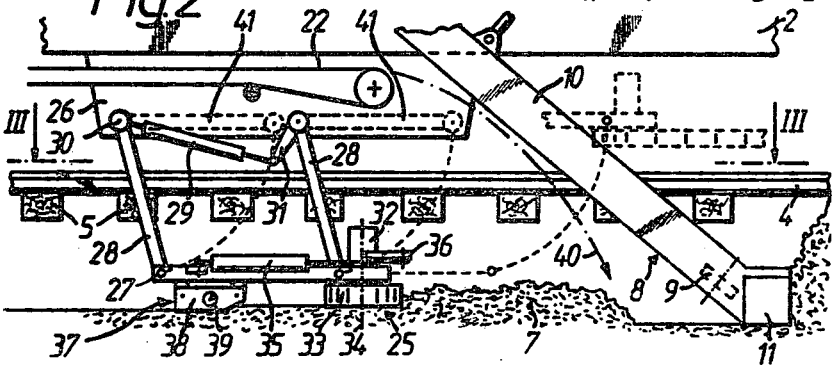
FIG. 2 is an enlarged side elevational view of the ballast leveling apparatus.
Figure 3:
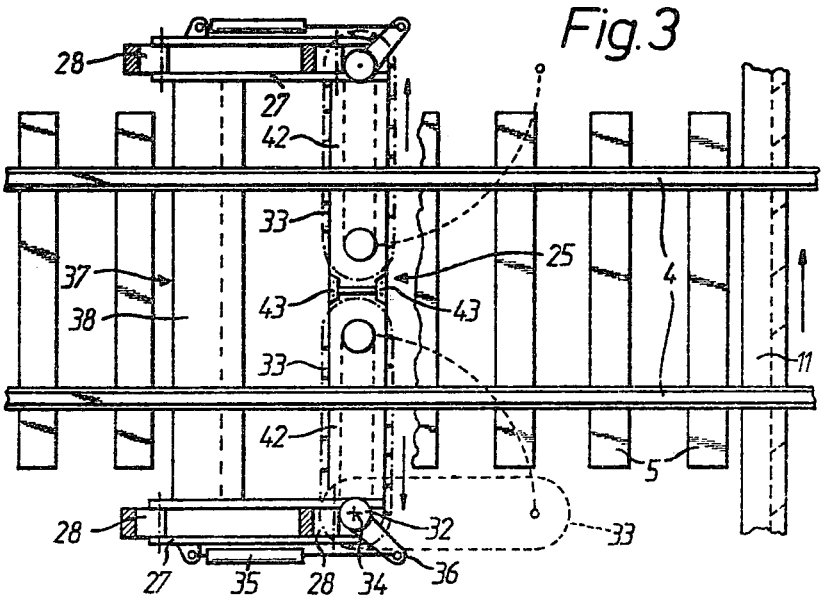
FIG. 3 is a top view taken along line III—III of FIG. 2.

As best shown in FIGS. 2 and 3, ballast leveling apparatus 25 is comprised of a pair of endless ballast leveling chains 33, vertical pivot 34 supporting a respective ballast leveling chain for pivoting in a plane underneath the track, as indicated in broken lines in FIG. 3, rotary drive 32 for driving each ballast leveling chain in the direction indicated by transverse arrows in FIG. 3, and power drive 29 illustrated as a hydraulic motor linking each ballast leveling chain 33 to machine frame 2 for vertically adjusting the ballast leveling chain independently of the ballast excavating means.

According to a preferred feature of the invention, a parallelogram guide mechanism comprising two parallel guide rods 28, 28 having one end pivoted at 30 to machine frame support part 26 mounts each ballast leveling chain 33 on the machine frame for horizontal and vertical movement, power drive 29 being connected to the parallelogram guide mechanism for adjustment thereof. In the illustrated embodiment, one end of power drive 29 is linked to pivot 30 of one guide rod 28 while the opposite end thereof is linked to drive arm 31 fixedly secured to the other guide rod 28. This arrangement enables the power drive to move the guide rods from an operating position of ballast leveling apparatus 25, shown in full lines in FIG. 2, to a rest position shown in broken lines.

This simple guide structure for the ballast leveling chain enables each chain to be vertically and horizontally adjusted in relation to the ballast excavating means and to the ballast bed. The guide structure moves in a vertical plane extending in the direction of the machine frame and the track, requiring little space in a transverse direction and enabling the ballast leveling chains to be readily moved between rest and operating positions at the beginning and the end of the operation. In the rest position, the apparatus is high above the track level and does not interfere with travel of the machine from and to the operating site. In the operating position, the apparatus can be readily pivoted to a level below the track grade. Furthermore, the use of guide rods in a parallelogram guide mechanism has considerable advantages over vertical guides which must be rather long and quite massive to support a scraper chain for vertical adjustment over the required considerable adjustment stroke and to enable the operating forces resulting from the heavy loads to which the scraper chains are subjected during leveling to be absorbed. The suspension of the ballast leveling chains on two guide rods moving in tandem creates none of these problems and provides a simple and relatively lightweight guide structure.

In accordance with another preferred feature of the invention, a pair of elongated carriers 27 extend in the direction of the track at each side of machine frame 2, each carrier 27 supporting a respective ballast leveling chain 33. Each chain has a guide housing 42 and pivoting arm 36 is fixedly secured to each guide housing. Power drive 35 illustrated as a hydraulic motor has one end linked to elongated carrier 27 and another end linked to pivoting arm 36 for pivoting each ballast leveling chain about vertical pivot 34.

This arrangement has the advantage of providing a readily replaceable structural unit incorporating the ballast leveling chain and its power drive, the driving forces being transmitted directly to the chain and its carrier without the need of further power transmissions.

According to yet another preferred feature of the present invention, ballast compacting device 37 is arranged rearwardly of ballast leveling chains 33 in the operating direction indicated by arrow 19. The compacting device is comprised of beam 38 extending transversly to the track and having respective ends preferably resiliently connected to elongated carriers 27 at the respective sides of machine frame 2. Vibrator 39 is mounted on beam 38 for vibrating the beam.

As has been mentioned hereinabove, the ballast leveling apparatus of this invention provides optimal ballast bed conditions for the subsequent compacting of the leveled but relatively loose ballast. The vibratory transverse beam mounted behind the ballast leveling apparatus on the carriers for the leveling chains enables the ballast to be compacted to any desired density. The control of the degree of ballast compaction desired may be readily effected by vertically adjusting the compacting beam in relation to the vertical position of the leveling chains.

In the operation of the illustrated machine hereinabove described, ballast is automatically leveled in successive regions of a ballast bed having two shoulders laterally adjacent track 6 supported on ballast bed 7. In this method, ballast is excavated underneath each region of the ballast bed by excavating conveyor chain 8, the excavated ballast is cleaned in screening arrangement 16 and the cleaned ballast is redistributed in the region by being thrown off the discharge ends of elongated conveyors 22 in the direction indicated by chain-dotted arrow 40 in FIG. 2. The cleaned ballast is laid on the sub-grade over the entire width of the ballast bed and has a surface layer of uneven ballast distribution. Excess ballast is removed from the surface layer to a predetermined, controlled depth determined by the vertical position of ballast leveling chains 33 and the removed surface layer ballast is simultaneously removed in two paths from the center of the ballast bed towards the shoulders, as indicated by the transverse arrows in FIG. 3, while filling any depressions in the ballast bed in the paths of the conveyed ballast with the conveyed ballast to level the ballast bed in the region. The leveled but relatively loose ballast bed is then compacted by applying vibratory pressure forces thereto in the region to compact the ballast until a predetermined compaction of the ballast has been obtained, at which time operation of vibratory compactor beam 38 is discontinued.

A cleaned, leveled and compacted ballast bed prepared in an existing track according to the method of the invention has substantially the same level accuracy, uniformity and surface condition as a newly laid ballast bed on which a track is subsequently laid. Subsequent tamping of the ties will involve only minor track position corrections to obtain the desired track grade.

FIG. 2 schematically indicates another modification in which pivots 30 for the upper ends of guide rods 28 are adjustably mounted in elongated guide tracks 41 defined in machine frame part 26. In this manner, ballast leveling apparatus 25 may be repositioned in the operating direction indicated by arrow 19 while ballast cleaning machine 1 continuously advances along the track. This enables the forward movement of leveling chains 33 in the operating direction to be temporarily reduced, for example, if heavy accumulations of ballast are encountered. It also makes it possible to move elongated carriers 27 forwardly in the rest position for leveling apparatus 25 when free space has become available by disassembling excavating chain 8 and raising elongated chain guides 10. In this forward rest position, leveling chains 33 are pivoted about pivot 34 into a position extending parallel to the track, as shown in broken lines in FIG. 3.

For the sake of clarity, ties 5 in the region of ballast leveling apparatus 25 have been omitted in the top view shown in FIG. 3. In the operating position of the leveling apparatus illustrated in full lines, wherein the leveling chains are pivoted inwardly so that the ends of chain guide housings 42 opposite a respective vertical pivot 34 face each other, detachable fishplates or like connecting elements 43 rigidly interconnect the chain housings at the ends thereof. The connecting elements may be attached by screws or bolts for ready detachment. This detachable connection imparts considerable rigidity and resistance to the reaction forces coming from the ballast to the leveling apparatus. The resultant structural unit is very rigid and able to resist even extreme operating pressures without being deformed. More importantly, compared to a chain arrangement wherein the inner ends of the chains freely project towards the track center, locking the inner ends of the ballast leveling chains together completely removes any load from the pivoting drives and reduces the bending forces to which the guide housings of the chains are subjected.

As shown in broken lines in FIG. 3, when ballast leveling chains 33 are outwardly pivoted to extend parallel to the track, they have a sufficient lateral distance from the tie ends to enable the chains to be vertically adjusted between the rest and operating positions without interference by track ties 5.

In the preferred embodiment described herein, the ballast excavating means has a portion 11 extending transversely of, and underneath, track 6 and conveyor means 22 have a discharge portion for depositing the cleaned ballast in the excavated region of ballast bed 7, the transversely extending excavating means portion and the conveyor means discharge portion being arranged forwardly of the ballast leveling chains in the operating direction and ballast compacting device 37 being arranged rearwardly of the ballast leveling chains in the operating direction. This arrangement not only assures a rational succession of the operating stages but it also produces a particularly space-saving positioning of all the essential structures in the track direction, resulting in a relatively short machine. Thus, the otherwise unused space laterally adjacent ballast redistributing conveyors 22 can be used for mounting the parallelogram guides and carriers for the ballast leveling chains. Existing ballast cleaning machines may, therefore, often be retrofitted with the apparatus of this invention.

Many variations and modifications of structural details may occur to those skilled in the art without departing from the spirit and scope of the present invention as defined in the appended claims, particularly with respect to the connection of the ballast leveling and compacting apparatus to the machine frame. For example, the two elongated carriers for the ballast leveling chains could be vertically slidably mounted on vertical columns affixed to the machine frame and the hydraulic motors may be replaced by any suitable power drive, such as threaded spindles. Furthermore, a reference system may be provided and the vertical adjustment of the ballast leveling and/or compating apparatus may be automatically responsive to such a reference system. The leveling apparatus may also be mounted on ballast cleaning machines capable of cleaning ballast in track switches, an extension of the pivoting range of the ballast leveling chains towards the ballast bed shoulders considerably increasing the operating range of the leveling apparatus over the width of the switch.

What we claim is:

1. A ballast leveling apparatus mounted on a ballast cleaning machine including a frame and adapted to move in an operating direction on a track including ties resting on a ballast bed having two shoulders laterally adjacent the track, the machine frame supporting a ballast excavating means for removing ballast from a region of the ballast bed underneath the track, a ballast screening arrangement for separating the removed ballast into cleaned ballast and waste, and conveyor means for redistributing cleaned ballast to the excavated region of the ballast bed, and the ballast leveling apparatus being comprised of (a) a pair of endless ballast leveling chains for distributing the redistributed cleaned ballast over the ballast bed and for leveling the distributed cleaned ballast, (b) a vertical pivot supporting a respective one of the endless ballast leveling chains for pivoting inwardly from a respective one of the ballast bed shoulders in a plane underneath the track, (c) a rotary drive for driving each ballast leveling chain, and (d) a power drive linking each ballast leveling chain to the machine frame for vertically adjusting the ballast leveling chain independently of the ballast excavating means.

2. The ballast leveling apparatus of claim 1, further comprising a parallelogram guide mechanism mounting each ballast leveling chain on the machine frame for horizontal and vertical adjustment, the power drive being connected to the parallelogram guide mechanism for adjustment thereof.

3. The ballast leveling apparatus of claim 2, wherein the parallelogram mechanism comprises two parallel guide rods having one end pivoted to the machine frame.

4. The ballast leveling apparatus of claim 3, further comprising a pair of elongated carriers extending in the direction of the track, each carrier supporting a respective one of the ballast leveling chains, a guide housing for each chain, a pivoting arm fixedly secured to the guide housing of each chain, and a power drive for each chain having one end linked to each elongated carrier and another end linked to each pivoting arm for pivoting each ballast leveling chain about the vertical pivot.

5. The ballast leveling apparatus of claim 4, further comprising a ballast compacting device arranged rearwardly of the ballast leveling chains in the operating direction, the compacting device being comprised of a beam extending transversely to the track and having respective ends connected to the elongated carriers.

6. The ballast leveling apparatus of claim 5, wherein the beam ends are resiliently connected to the elongated carriers.

7. The ballast leveling apparatus of claim 5 or 6, further comprising a vibrator means for vibrating the beam.

8. The ballast leveling apparatus of claim 1, further comprising a guide housing for each endless ballast leveling chain, each guide housing having an end opposite a respective one of the vertical pivots, and detachable fishplates for rigidly interconnecting the chain guide housings at the ends thereof.

9. The ballast leveling apparatus of claim 1, wherein the ballast excavating means has a portion extending transversely of, and underneath, the track and the conveyor means has a discharge portion for depositing cleaned ballast in the excavated region of the ballast bed, the transversely extending excavating means portion and the conveyor means discharge portion being arranged forwardly of the ballast leveling chains in the operating direction.

10. The ballast leveling apparatus of claim 9, further comprising a ballast compacting device arranged rearwardly of the ballast leveling chains in the operating direction.

* * * * *